United States Patent [19]

Deutsch

[11] Patent Number: 4,646,608

[45] Date of Patent: Mar. 3, 1987

[54] PHASED MEMORY ADDRESSING FOR NOISE REDUCTION IN AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 698,961

[22] Filed: Feb. 6, 1985

[51] Int. Cl.[4] ..... G10H 1/02; G10H 1/06; G10H 7/00

[52] U.S. Cl. ..... 84/1.01; 84/1.26

[58] Field of Search ..... 84/1.01, 1.26

[56] References Cited

U.S. PATENT DOCUMENTS

| | | | |
|---|---|---|---|
| 4,022,098 | 5/1977 | Deutsch | 84/1.01 |
| 4,085,644 | 4/1978 | Deutsch | 84/1.01 |
| 4,114,496 | 5/1977 | Deutsch | 84/1.01 |

*Primary Examiner*—Stanley J. Witkowski
*Assistant Examiner*—David Warren
*Attorney, Agent, or Firm*—Ralph Deutsch

[57] ABSTRACT

In a musical instrument in which a plurality of data words corresponding to the amplitudes of a corresponding number of evenly spaced points defining a cycle of an audible musical waveform are transformed at an average rate corresponding to the fundamental frequency of the tone being generated, a frequency generator is provided using a single clock source for selectively producing the entire frequency range of selected musical notes. A non-integer frequency generator is implemented which periodically adds a frequency number, corresponding to an actuated keyswitch, to itself in an accumulator. The integer portion of the accumulator content is used to address out waveshape values stored in a memory. The decimal portion of the accumulator content is used to select the time at which either the current read out waveshape data value or a previously read out waveshape data value is converted into an analog signal by means of a digital-to-analog converter. The time selection reduces the undesirable spectral noise components produced by the unequally spaced advance of the waveshape addresses associated with the integer portion of the accumulated content.

18 Claims, 5 Drawing Figures

PHASED MEMORY ADDRESSING FOR NOISE REDUCTION IN AN ELECTRONIC MUSICAL INSTRUMENT

BACKGROUND OF THE INVENTION

1. Field of the invention

This invention relates to electronic musical tone synthesis and in particular is concerned with an improvement for generating all the musical notes from a single master timing clock.

2. Description of the Prior Art

A commonly employed scheme for addressing out waveshape data points from a memory address advance rate corresponding to an actuated keyboard switch on a musical instrument is to use a method that is known by the generic name of a "frequency number system." In a frequency number memory addressing subsystem, each actuated ("on"position) keyswitch is assigned a corresponding frequency number. This assigned frequency number when multiplied by the logic master clock frequency produces the memory address advance rate at which data is accessed from a memory storing data representing a musical waveform. An objectionable noise producing mechanism is inherent in the use of such a non-integer dividing system. This noise is introduced because the frequency number is not a simple integer but instead it is some multiple of $2^{1/12}$ which is an irrational number. The use of non-integer dividers in a frequency number system produces pulse trains with pulses occuring at the desired correct average frequency corresponding to a frequency number. However, such pulse trains have intervals between pulses which are not constant in spacing.

A subsystem which employs a frequency number to implement a non-integer frequency division from a single master oscillator is described in U.S. Pat. Nos. 3,639,913 and 3,743,755 both of which are entitled Method and Apparatus For Addressing A Memory At Selectively Controlled Rates.

If a frequency number system is used to implement a non-integer frequency divider for creating memory addressing data in tone generators which store waveshape data in a memory, the unequal spacing of the memory advance information introduces highly objectionable noise in the musical tone generation system. This noise manifests itself in the form of undesirable frequency components which are not harmonically related to the musical tone's fundemental frequency. The result is a displeasing tone effect which appears to be produced by some sort of erratic tone distortion.

Waveshape interpolation between stored data point values has been employed in an effort to reduce the noise inherent in a frequency number system used to read stored waveshape data points from a waveshape memory. In U.S. Pat. No. 4,036,096 entitled Musical Tone Waveshape Generator a system is described in which two memories are used to store identical values of a digital number representation of a musical waveshape. The desired data value for a particular instant of time is obtained by computing a linear interpolated value from the two stored sets of waveshape data points.

An imporoved noise reduction in a frequency number memory advance system is described in U.S. Pat. No. 4,256,003 entitled "Note Frequency Generator For An Electric Musical Instrument." This patent described a musical tone generating system in which a plurality of digital data words corresponding to the amplitudes of a corresponding number of evenly spaced points defining a period of musical waveform are read out of a memory at an average memory advance rate proportional to the pitch of the tone being generated. A frequency timing generator is used which employs a single master clock source for selectively producing the entire range of musical notes. A non-integer frequency clock genreator is implemented which operates by adding a frequency number repetitively to the contents of an accumulator contained in an adder-accumulator combination. The most significant bits of the accumulated sum is used to access waveshape data values that are stored in a waveshape memory. The noise produced by the unequal spacing of the memory advance data is reduced by applying optimum amplitude weighting values to a sequence of output data values and then summing these weighted amplitude values to obtain a single data value which is converted into an analog signal and provided as the desired musical signal.

The source of the noise problem encountered in waveshape memory addressing systems that employ frequency number addressing subsystems for reading out data values of musical waveshapes stored in memory is that the memory address is obtained from the repetitively accumulated sum of a frequency number. This accumulated sum consists of an integer portion and a fraction or decimal portion. The integer portion is used as an address to access a data point from the waveshape memory. Unfortunately the required waveshape value is one that corresponds to the entire accumulated sum including both the integer and decimal portions. The waveshape memory does not contain a data point for all possible decimal portions of the sum. If only the integer portion is used to access a stored waveshape data point, the resultant waveform will contain noise in the form of undesriable spectral components.

A commonly employed technique to reduce noise in a waveshape memory addressing system using an accumulated frequency number is to implement a linear interpolation computational algorithm to approximate the missing stored data value corresponding to both the integer portion and the decimal portion of the of the accumulated frequency number. Instead of using the entire available decimal portion, it is frequently more economical in terms of the hardware configuration to divide the spacing between successive stored data points into some fraction which is a power of two. The decimal portion of the accumulated frequency number is then approximated by the power of two which is less then or equal to the decimal portion.

The use of linear interpolation in a frequency number system as a noise reduction technique has inherent limitations. Since in such a technique the waveshape between the successive stored data points is tacitly assumed to be a straight line, linear interpolation at best can only provide an approximation to the true waveshape data value corresponding to the accumulated frequency number. This error, or glitch, in the generated musical waveshape will occur at different places in successive periods of the read out waveshape because of the irrationality of the frequency number. The net result is a residual noise comprising undesirable spectral components. Another source of noise is the use of an approximation to the decimal portion of the accumulated frequency number by a fixed fraction which is a power of two. Increasing the number of such interpolation fractions does little to improve the noise reduction because the limiting error source lies in the straight line approximation between successive stored waveshape sample points.

The present invention provides a novel subsystem for reducing the residual noise in an accumulated frequency number system and which does not employ a linear interpolation computational algorithm.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is generated. A master data set comprises a set of data points which define a period of a musical waveshape.

A frequency number is generated corresponding to an actuated keyboard switch. The frequency number is used to implement a non-integer frequency generator by periodically adding the frequency number to an accumulator in an adder-accumulator combination. The integer portion of the accumulated sum of the frequency number is used to address out an element of the master data set which is stored in a waveshape memory at the end of a computation cycle. The decimal portion of the accumulated sum of the frequency number is used to determine if the addition of another frequency number will cause an increment to the integer portion. If such an increment will occur, a phase select means advances the time at which the next master data set point will be read out of the waveshape memory. The selected time advance circuitry reduces the amount of undesirable spectral noise that would be generated in the absence of the advance time select feature of the inventive system.

BRIEF DESCRIPTION OF THE DRAWINGS

The detailed description of thhe invention is made with reference to the accompanying drawings wherein like numerals designate like components in the figures.

DETAILED DESCRIPTION OF THE INVENTION

The present invention is directed toward an improvement in the note clock generating system of the type described in detailed in U.S. Pat. No. 4,085,644 entitled Polyphonic Tone Synthesizer. This patent is hereby incorporated by reference. In the following description all elements of the system which are described in the referenced patent are identified by two digit numbers which correspond to the same numbered elements appearing in the referenced patent U.S. Pat. No. 4,085,644.

Figure 1:
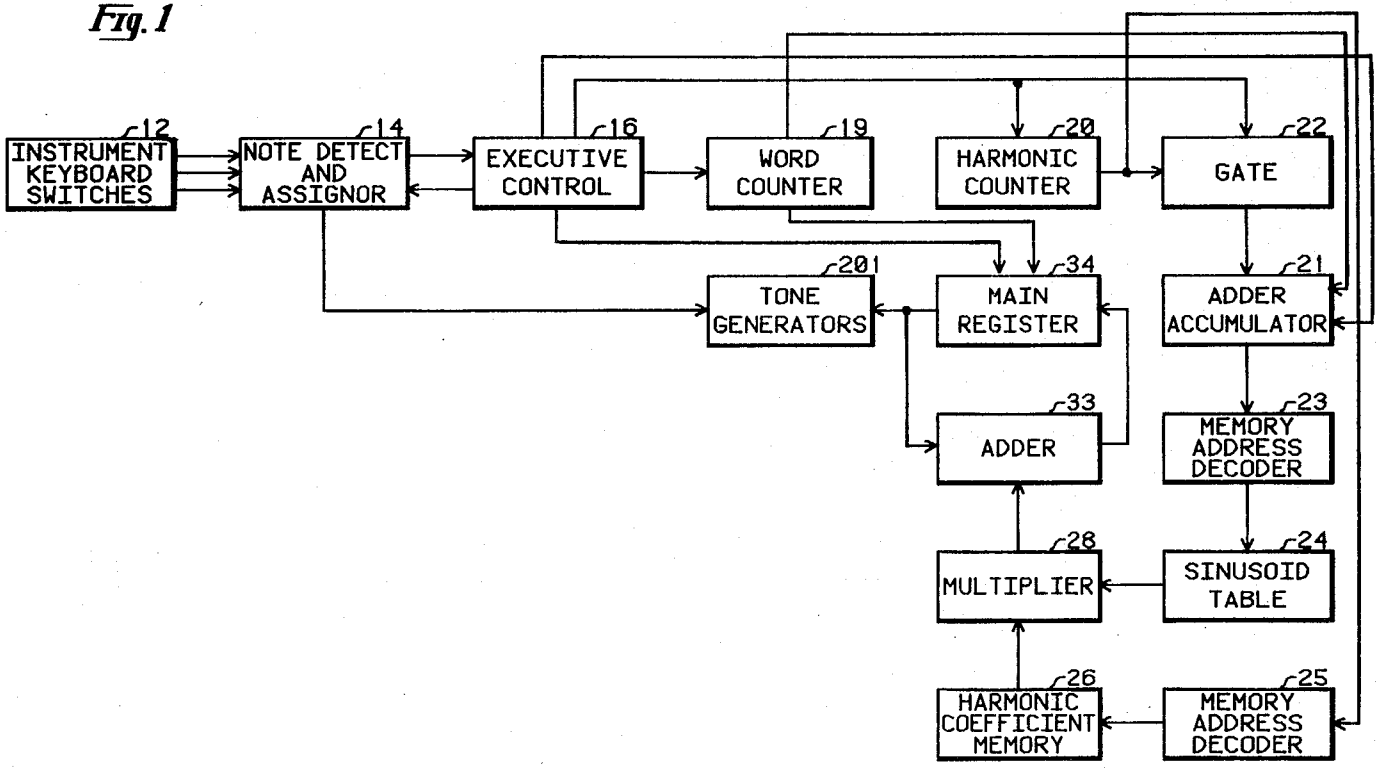
FIG. 1 is a system block diagram of the musical waveforms generator.

FIG. 1 shows an embodiment of the present invention which is described as a modification and adjunct to the system described in the referenced patent U.S. Pat. No. 4,085,664.

As described in the above referenced patent, the Polyphonic Tone Synthesizer includes an array of instrument keyboard switches 12. If one or more of the keyboard switches has switch status change and is actuated ("on" switch position), the note detect and assignor 14 encodes the detected keyboard switch having the status change to an actuated state and stores the corresponding note information for the actuated keyswitches. A tone generator, contained in the block labeled tone generators 201, is assigned to each actuated keyswitch using information generated by the note detect and assignor 14.

A suitable configuration for a note detect and assignor subsystem is described in U.S. Pat. No. 4,022,098. This patent is hereby incorporated by reference.

When one or more keyswitches have been actuated, the executive control 16 initiates a repetitive sequence of computation cycles. During each computation cycle, a master data set is computed. Each master data set contains 64 data words which are used to create a musical tone in a manner described below. The maximum number of harmonics in the the generated musical tone is no more than 32 or one-half of the number of data points which comprises a master data set.

It is desirable to be able to continuously recompute and store the master data set during a repetitive sequence of computation cycles and to load this data into note registers while the actuated keyswitches remain actuated, or depressed, on the keyboards. There is a note register associated with each tone generator contained in the system block labeled tone generators 201.

As described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its minimal, or zero count, state because of its modulo counting implementation, a signal is generated by the executive control 16 which increments the count state of the harmonic counter 20. The word counter 19 is implemented to count modulo 64 which is the number of data words comprising the master data set.

At the start of each computation cycle, the accumulator in the adder-accumulator 21 is initialized to a zero value by the executive control 16. Each time that the word counter 19 is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric function values from the sinusoid table 24. The sinusoid table 24 is advantageously implemented as a read only memory storing values of the trigonometric function $\sin(2\pi\theta/64)$ for $0 \leqq \theta \leqq 64$ at intervals of D. D is a table resolution constant.

The memory address decoder 25 is used to read out harmonic coefficients stored in the harmonic coefficient memory 26 in response to the count state of the harmonic counter 20. The harmonic coefficient memory 26 stores 32 harmonic coefficients whose values determine the strength of the 32 harmonics in the generated musical tones.

The multiplier 28 creates the product of the value of the trigonometric function data value read out from the sinusoid table 24 and the value of the harmonic coefficient read out from the harmonic coefficient memory 26. The created value product formed by the multiplier 28 is furnished as one input to the adder 33.

The contents of the main register 34 are initialized to zero values by the executive control 16 at the start of each computation cycle. Each time that the word counter 19 is incremented in response to a timing signal provided by the executive control 16, the content of the main register 34, at an address corresponding to the count state of the word counter 19, is read out and furnished as an input to the adder 33. The sum of the data inputs to the adder 33 are stored in the main register 34 at a memory location equal, or corresponding, to the count state of the word counter 19. After the word counter 19 has been cycled for 32 complete cycles of 64 counts, the main register 34 will contain the master data set.

Following each computation cycle, in the repetitive sequence of computation cycles, a transfer cycle is initiated and executed. During a transfer cycle the master data set is copied from the main register 34 to an assigned note register. There is a note register associated with each of the tone generators contained in the system block labled tone generators 201.

Figure 2:
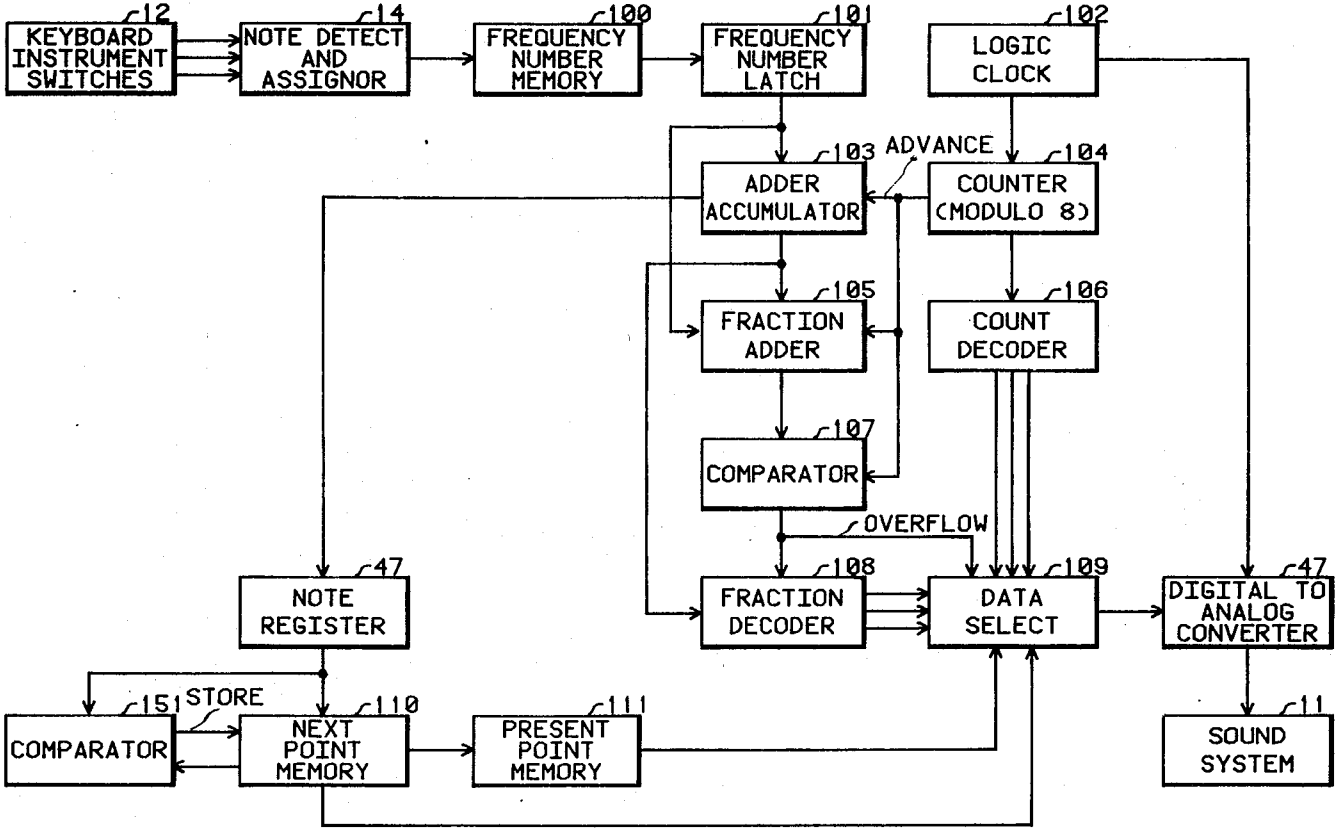
FIG. 2 is a block diagram of a tone generator.

FIG. 2 illustrates the details of one of the tone generators contained in the system block labeled tone generators 201. While only one tone generator is shown explicitly in FIG. 2, it is tacitly assumed that a similar arrangement is replicated for each of the plurality of tone generators.

When the note detect and assignor 14 detects that a keyboard switch has been actuated, a corresponding frequency number is read out from the frequency number memory 100. The frequency number memory 100 can be implemented as a read-out addressable memory (ROM) containing data words stored in binary numeric format having values $2^{-(M-N/12}$ where N has the range of values N=1,2, . . . , M and M is equal to the number of keyswitches on the musical instrument's keyboard. The frequency numbers represent the ratios of frequencies of generated musical tones with respect to the frequency of the system's logic clock. A detailed description of the frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 100 is stored in the frequency number latch 101.

A string of equally spaced timing pulses are produced by the logic clock 102. The counter 104 is incremented by the timing pulses furnished by the logic clock 102. Counter 104 is implemented to count modulo 8. It is apparent fron the following description of the noise reduction subsystem that other molulo counts can be used for the counter 104. The maximum count state of the counter 104 is called the phase resolution number.

Each time that the counter 104 is incremented to its minimal count state of 1, an ADVANCE signal is generated and furnished to the adder-accumulator 103 and the fraction adder 105. The decimal count state of 1 is equivalent to the binary count state of zero or 000.

In response to the ADVENCE signal, the frequency number stored in the frequency number latch 101 is added to the content of the accumulator contained in the adder-accumulator 103. The content of this accumulator is the accumulated sum of frequency numbers.

A waveshape data point from the master data set is read out from the note register in response to the six most significant bits of the accumulated frequency number contained in the adder-accumulator 103. These six most significant bits correspond to the integer portion of the accumulated frequency number.

The comparator 151 compares the data value read out of the note register with the data value stored in the next point memory 110. If these two data values are not equal then the comparator 151 generates a STORE signal. In response to a STORE signal the data value residing in the next point memory 110 is transferred into the present point memory 111 and the data value read out of the note register 47 is stored in the next point memory 110.

The result of these compare and store operations is that the current waveshape data point is stored in the present point memory 111 and the next waveshape data point is stored in the next point memory 110. The remainder of the logic showm in FIG. 2 is used to determine the time at which either the current waveshape data point or the next waveshape data point is furnished to the digital-to-analog converter 47.

The counter decoder 106 decodes the binary count state of the counter 106 and provides a signal on one of the lines connected to the data select 109. While only three lines are shown explicitly in FIG. 2, this is a drawing convenience to represent the eight lines corresponding to the modulo 8 implementation of the counter 104.

The fraction adder 105 adds the frequency number contained in the frequency number latch 101 to the fraction, or decimal, portion of the accumulated frequency number contained in the adder-accumulator 103. This addition is made in response to the ADVANCE signal generated by the counter 104. The fraction portion of the accumulated frequency number consists of the remainder of the bits of the binary words following the six most significant bits.

In response to the ADVANCE signal, the comparator 107 compares the sum produced by the fraction adder 105 to the binary value of unity, or 1. If the sum is greater to or equal to unity, then an OVERFLOW signal is generated by the comparator 107. The creation of the OVERFLOW signal indicates that the next time that the accumulator in the adder-accumulator 103 is incremented by the frequency number stored in the frequency number latch 101, the number represented by the six most significant bits of the accumulated frequency number will advance by one. This implies that when the next ADVANCE signal is generated that a new data point will be read out of the note register 47 for a memory advance address of one increment.

In response to the generation of an OVERFLOW signal by the comparator 107 it is necessary to select the data point stored in the next point memory 110 at a time before the next ADVANCE signal is generated by the counter 104. The selection of either the data value stored in the next point memory 110 or the data value stored in the present point memory 111 is made by the data select 109.

In response to an OVERFLOW signal generated by the comparator 107, the fraction decoder 108 decodes the three most significant bits of the fraction, or decimal, portion of the accumulated frequency number contained in the adder-accumulator 103. The decoder number is transmitted on one of the eight signal lines which transfer signal data from the fraction decoder 108 to the data select 109.

If the OVERFLOW signal is not generated, then the data select 109 transfers the data value stored in the present point memory 111 to the digital-to-analog converter 47. If the OVERFLOW signal is generated then the data select 109 will transfer the data value stored in the next point memory to the digital-to-analog converter 47 if the count state of the counter 104 is greater or equal to the number represented by the three most significant bits of the fraction portion of the accumulated frequency number contained in the adder-accumulator 103. This data selection is made in response to the data transmitted to the data select 109 by the fraction decoder 108 and the count decoder 106.

Figure 3:
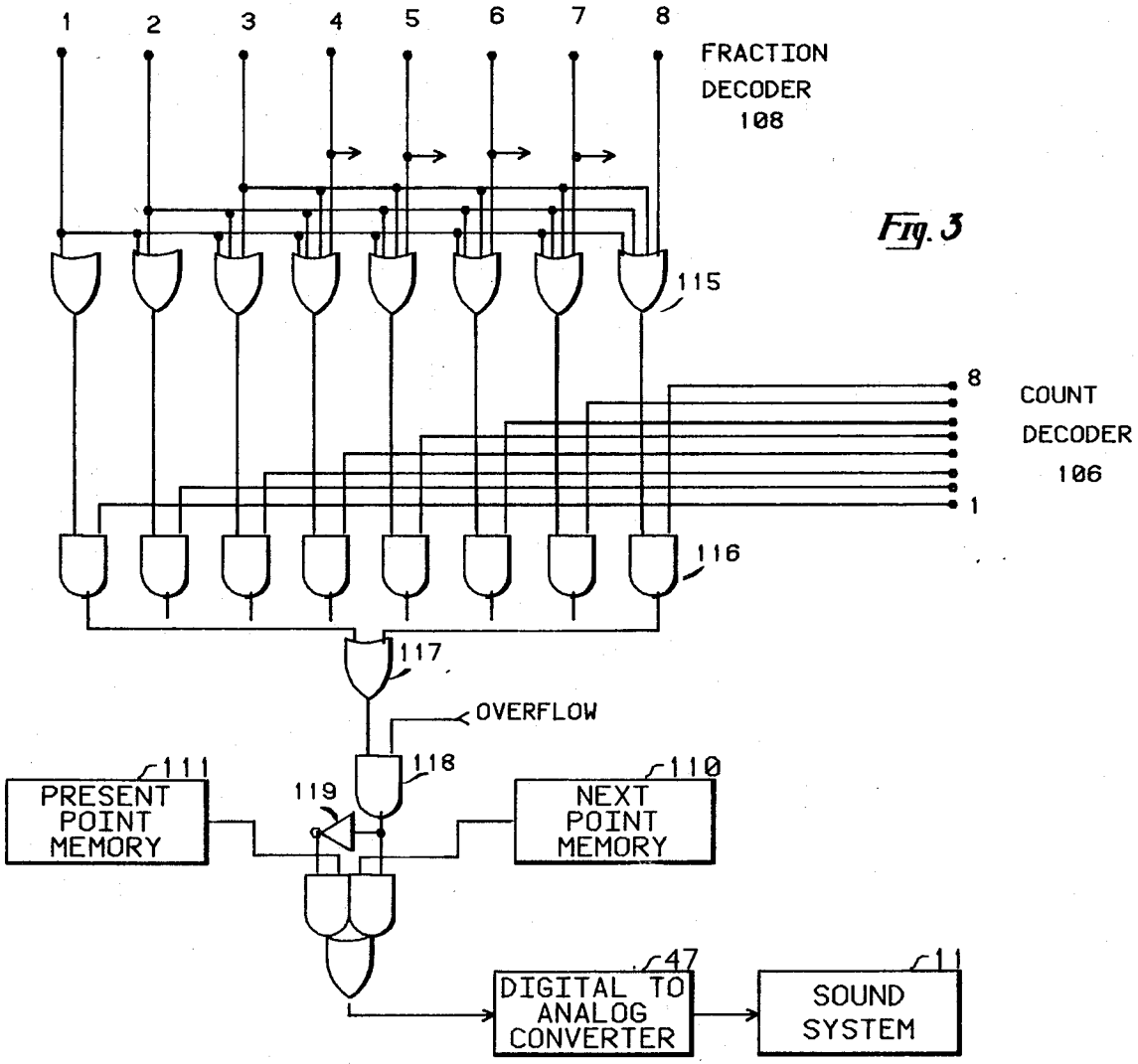
FIG. 3 is a logic diagram of the data select 109.

An implementation of the data select 109 is shown in FIG. 3. The eight signal lines from the fraction decoder 108 are connected as shown to the set of OR-gates 115. Line 1 is connected to each of the OR-gates. Line 2 is connected to the set of OR-gates 2 to 8. Line 3 is connected to the set of OR-gates 3 to 8. Although for clarity the detailed connections are not shown for the other lines, they are connected in a manner analogous to that shown for the first three lines.

The output signal from each of the set of OR-gates 115 is connected to an input of a corresponding gate in the set of eight AND-gates 116. The corresponding signals from the count decoder 106 are also connected to the set of AND-gates 116. The output signals from the set of AND-gates 116 are combined by means of the OR-gate 117.

If the OVERFLOW signal is generated, then the AND-gate 118 will produce a binary "1" logic state signal for each count state of the counter 104 which is greater than or equal to the binary number which is equal to the three most significant bits of the fraction portion of the accumulated frequency number. In response to a "1" state from the AND-gate 118, the data value stored in the next point memory 110 is transferred to the digital-to-analog converter 47. In response to a "0" state from the AND-gate 118, the data value stored in the present point memory 111 is transferred to the digital-to-analog converter 47.

The output signal produced by the digital-to-analog converter 47 is converted into an audible musical tone by means of the sound system 11.

Figure 4:
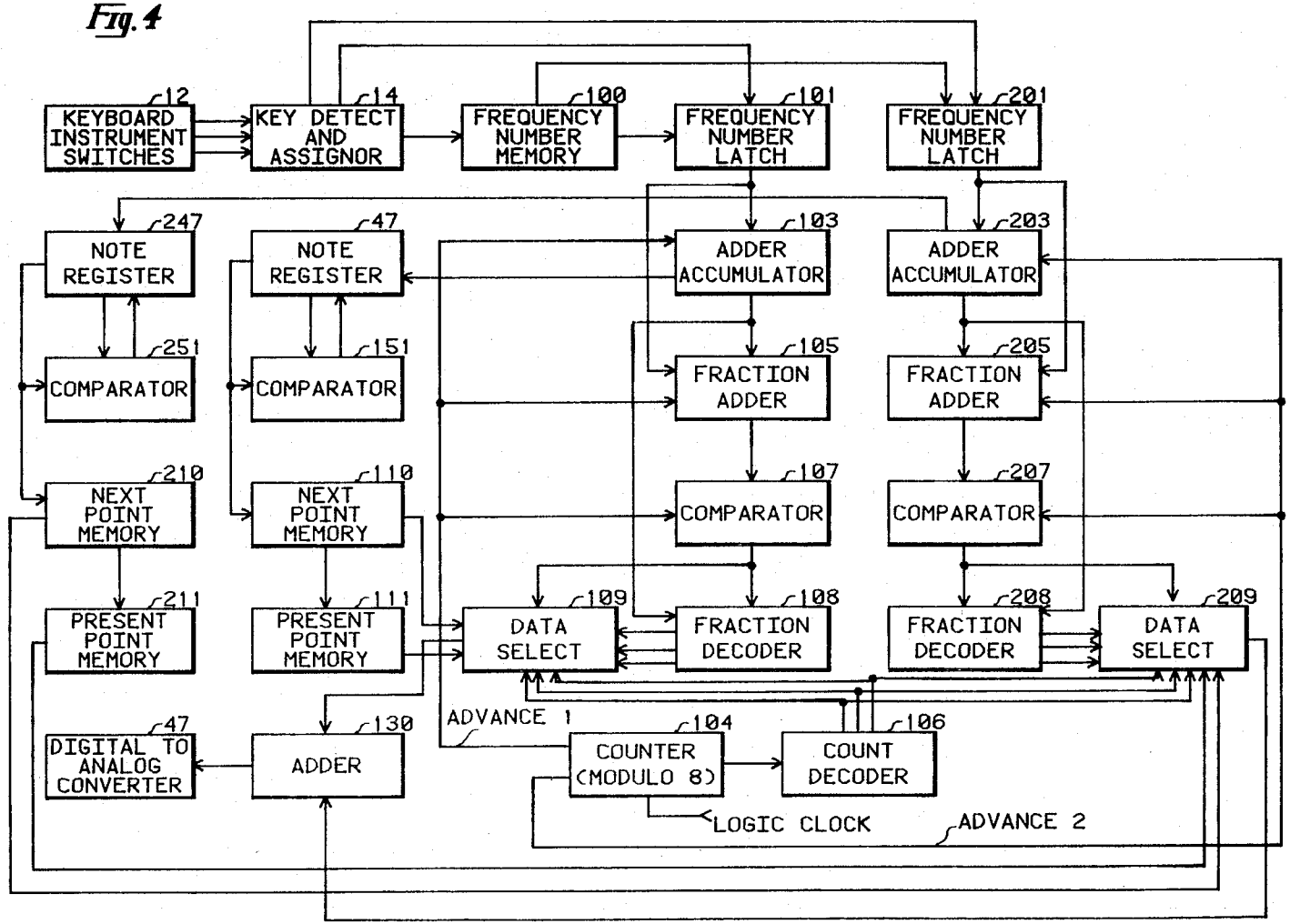
FIG. 4 is an alternate embodiment of the invention.

FIG. 4 illustrates an embodiment of the present invention with an extension to a polyphonic musical tone generator. While only two tone generators are shown explicitly in FIG. 4, the extension to a larger number of tone generators will be obvious from FIG. 4 and the following system operation description. The system element blocks with a hundred series number either belong to the first tone generator or are shared by all the tone generators. The system element blocks with a two hundred series number belong to the second tone generator. At the end of a computation cycle the master data set residing in the main register 34 (FIG. 1) is copied into the note register 47 and the note register 247 during a transfer cycle.

In response to the first detected keyboard switch closure, the key detect and assignor 14 addresses out a corresponding frequency number from the frequency number memory 100 and this frequency number is stored in the frequency number latch 101. In response to a second detected keyswitch closure, occurring while the first keyboard switch remains actuated, the key detect and assignor 14 addresses out a corresponding frequency number from the frequency memory 100 and this frequency number is stored in the frequency number latch 201.

The first tone generator's adder-accumulator 103 receives its frequency number increments in response to the ADVANCE signal generated by the counter 104. The ADVANCE signal is generated when the counter 104 is in its minimal count state corresponding to a decimal count number of 1 (binary count 000). The adder-accumulator 203 assiciated with the second tone generator receives a frequency number increment when the counter 104 is in its second count state corresponding to the decimal count of 2.

The adder 130 which is inserted before the digital-to-analog converter 47, is necessary because with a time displacement noise reduction subsystem, it is very likely that more than one tone generator will change to its next data point at the same time that one of the other tone generators also provides an output data point to the digital-to-analog converter 47 which is shared by all the tone generators.

In the system shown in FIG. 2, the conversion speed of the digital-to-analog converter 47 is timed by the timing pulses produced by the logic clock 102. This conversion speed is eight tines greater than the conversion speed that would normally be used for a noise reduction subsystem that employed a linear interpolation computation algorithm.

Figure 5:
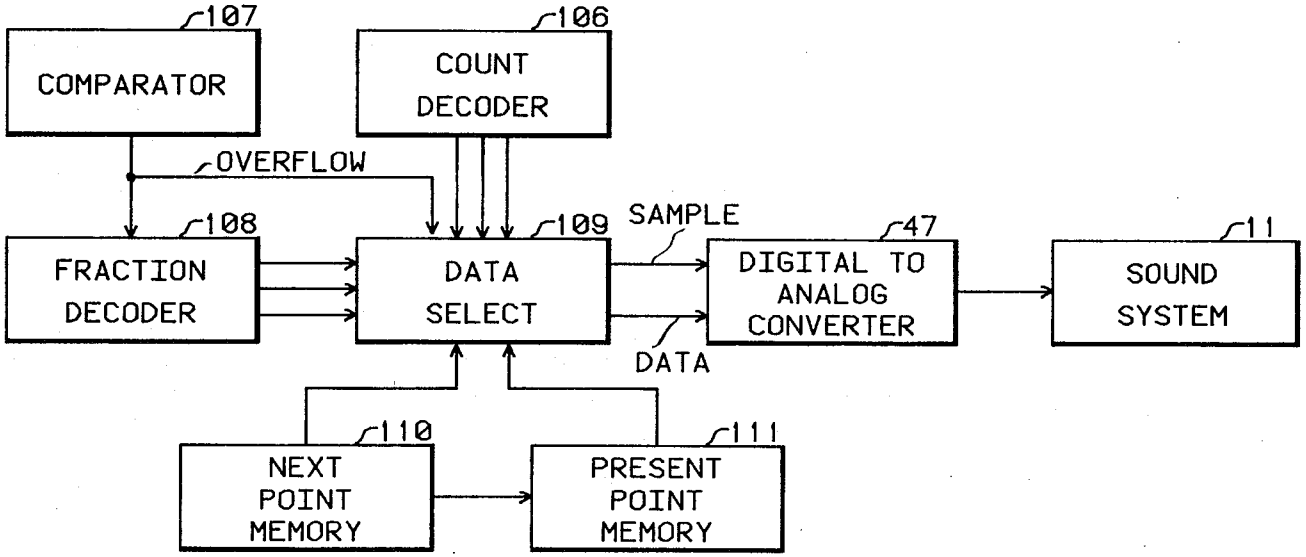
FIG. 5 is a second alternate embodiment of the invention.

The subsystem arrangement shown in FIG. 5 can be used to reduce the conversion speed required for the digital-to-analog converter 47. When the data select 109 receives the OVERFLOW signal from the comparator 107 and the signal from the count decoder 106 matches the signal from the fraction decoder, a SAMPLE signal is generated. In response to the SAMPLE signal, the digital-to-analog converter 47 converts its input binary data signal into an analog signal. In this fashion, the conversion speed for the digital-to-analog converter 47 is adaptive to the time at which its input data changes. Thus the conversion speed is never greater than that required for a waveshape memory read out system that has no provision for noise reduction, or uses a conventional linear interpolation computation algorithm. The SAMPLE signal can be obtained from the output of the AND-gate 118 shown in FIG. 3.

I claim:

1. In combination with a keyboard operated musical instrument having a plurality of keyswitches in which a plurality of data words corresponding to the amplitudes of evenly spaced points defining the waveform of a musical tone are computed from a preselected set of harmonic coefficients and are transferred sequentially and converted into musical waveshapes at a rate proportional to the pitch of the musical tone being generated, apparatus for reducing undesirable frequency components in the musical tone comprising;

a harmonic coefficient memory means for storing a preselected set of harmonic coefficients, a waveshape memory means, a harmonic addressing means for reading out the set of harmonic coefficients from said harmonic coefficient memory means, a computing means responsive to said read out set of harmonic coefficients whereby said plurality of data words corresponding to the amplitudes of evenly spaced points defining said waveform of a musical tone are computed and stored in said waveshape memory means, a frequency number generating means for providing frequency numbers corresponding to the fundamental frequencies of musical notes produced by said musical instrument, an assignor means whereby a frequency number is selected from said frequency number generating means in response to an actuated keyswitch in said plurality of keyswitches, an adder-accumulater means for successively adding said selected frequency number to produce an accumulated sum of frequency numbers comprising and integer portion and a decimal portion, a memory addressing means from reading out a data word from said waveshape memory means at an address corresponding to the integer portion of the accumulated sum of frequency numbers contained in said adder accumulator means, a phase detect means responsive to the integer portion and to the decimal portion of the accumulated sum of frequency numbers contained in said adder-accululator means whereby a data word read from said waveshape memory means is selected and, a means for conversion whereby said selected data word from said phase detect means is converted into an analog signal corresponding to said musical tone.

2. Apparatus according to claim 1 wherein said harmonic addressing means comprises;

a clock for providing timing signals, a word counter for counting said timing signals modulo the number of said plurality of data words corresponding to a period of said waveform of a musical tone, a harmonic counter incremented each time said word counter returns to its minimal count state, and a harmonic address decoder responsive to the count state of said harmonic counter whereby elements of said preselected set of harmonic coefficients are read out from said harmonic coefficient memory means.

3. Apparatus according to claim 2 wherein said computing means comprises;

an adder-accumulator means wherein the count state of said harmonic counter is successively added to the contents of an accumulator in response to said timing signals, a sinusoid table for storing a plurality if trigonometric sinusoid function values, an address decoder means responsive to the content of said accumulator whereby an address signal is generated, a sinusoid addressing for reading out a trigonometric sinusoid function value from said sinusoid table in response to said address signal, and a master data set computing means responsive to said trigonometric sinusoid function value read out from said sinusoid table and to harmonic coefficients read out from said harmonic coefficient memory means whereby said plurality of data words corresponding to the amplitudes of evenly spaced points defining said waveform of a musical tone are computed and stored in said waveshape memory means.

4. Apparatus according to claim 1 wherein said frequency number generating means comprises a frequency number memory means for storing a set of frequency numbers.

5. Apparatus according to claim 4 wherein said assignor means comprises;

a frequency number addressing means whereby in response to an actuated keyswitch in said plurality of keyswitches a corresponding frequency number is read out from said frequency number memory means.

6. Apparatus according to claim 1 wherein said phase detect means comprises;

a next point memory means for storing said data word read out from said waveshape memory means, a present point memory means for storing a present point data value, a first comparator means whereby a compare signal is generated if the data word read out from said waveshape memory means is equal in numerical value to the data word stored in said next point memory means, and a data transfer means whereby the data word stored in said next point memory means is transferred and stored in said present point memory means if said compare signal is not generated.

7. Apparatus according to claim 6 wherein said adder-accumulator means comprises;

a logic clock for providing phase timing signals, and a phase counter for counting said phase timing signals modulo a specified phase resolutin number.

8. Apparatus according to claim 7 wherein said phase detect means further comprises;

a second comparator means whereby an overflow signal is generated if said selected frequency number added to the decimal portion of said accumulated sum of frequency numbers has a numerical value equal to or greater than unity, a data select means whereby the present point data value stored in said present point memory means is selected if said overflow signal is generated and whereby the data word stored in said next point memory means is selected if said overflow signal is generated and if the count state of said phase counter is greater than or equal to the decimal portion of said accumulated sum of frequency numbers.

9. Apparatus according to claim 8 wherein said data select means comprises;

a conversion signal generation means wherein a conversion signal is generated if said data word stored in said next point memory is selected.

10. Apparatus according to claim 9 wherein said means for conversion comprises;

a digital-to-analog converter means whereby the data word selected by said data select means is converted into an analog signal in response to said conversion signal.

11. In combination with a keyboard operated musical instrument having a plurality of keyswitches in which a plurality of data words corresponding to the amplitudes of evenly spaced points defining the waveform of a musical tone are read from a waveshape memory and read out sequentially and converted into musical waveshapes at a rate proportional to the pitch of the musical tone being generated, apparatus for reducing undesirable frequency components in the musical tone comprising;

a waveshape memory means, comprising said waveshape memory, storing said plurality of data words corresponding to the amplitudes of evenly spaced points defining the waveform of a musical tone, a frequency number generating means for providing frequency numbers corresponding to the fundamental frequencies of musical tones produced by said musical instrument, an assignor means whereby a frequency number is selected from said frequency number generating means in response to an actuated keyswitch in said plurality of keyswitches, an adder-accumulator means for successively adding said selected frequency number to produce an accumulated sum of frequency numbers comprising an integer portion and a decimal portion, a memory addressing means for reading out a data word from said waveshape memory means at an address corresponding to the integer portion of the accumulated sum of frequency numbers contained in said adder accumulator means, a phase detect means responsive to the integer portion and to the decimal portion of the accumulated sum of frequency numbers contained in said adder-accumulator means whereby a data word read from said waveshape memory means is selected, and a means for conversion whereby said selected data word from said phase detect means is converted into an analog signal corresponding to said musical tone.

12. Apparatus according to claim 11 wherein said frequency number generating means comprises a frequency number memory means for storing a set of frequency numbers.

13. Apparatus according to claim 12 wherein said assignor means comprises;

a frequency number addressing means whereby in response to an actuated keyswitch in said plurality of keyswitches a corresponding frequency number is read out from said frequency number memory means.

14. Apparatus according to claim 11 wherein said phase detect means comprises;

a next point memory means for storing said data word read out from said waveship memory means, a present point memory means for storing a present point data value, a first comparator means whereby a compare signal is generated if the data word read out from said waveshape memory means is equal in numerical value to the data word stored in said next point memory means, and a data transfer means whereby the data word stored in said next point memory means is transferred and stored in said present point memory means if said compare signal is not generated.

15. Apparatus according to claim 14 wherein said adder-accumulator means comprises;

a logic clock for providing phase timing signals, and a phase counter for counting said phase timing signals modulo a specified phase resolution number.

16. Apparatus according to clain 15 wherein said phase detect means further comprises;

a second comparator means whereby an overflow signal is genreated if said selected frequency number added to the decimal portion if said accumulated sum of frequency numbers has a numerical value equal to or greater than unity, a data select means whereby the present point data value stored in said present point memory means is selected if said overflow signal is generated and whereby the data word stored in said next point memory means is selected if said overflow signal is generated and if the count state of said phase counter is greater than or equal to the decimal portion of said accumulated sum of frequency numbers.

17. Apparatus according to claim 16 wherein said data select means comprises;

a conversion signal generation means wherein a conversion signal is generated if said data word stored in said next point memory is selected.

18. Apparatus according to claim 17 wherein said means for conversion comprises;

a digital-to-analog converter means whereby the data word selected by said data select means is converted into an analog signal in response to said conversion signal.

* * * * *